US009457450B2

(12) United States Patent
Chung et al.

(10) Patent No.: US 9,457,450 B2
(45) Date of Patent: Oct. 4, 2016

(54) PAD CONDITIONING TOOL

(71) Applicant: TERA XTAL TECHNOLOGY CORPORATION, Hsinchu (TW)

(72) Inventors: Jun-Wen Chung, Hsinchu (TW); Tzu-Hsuan Dai, Hsinchu (TW); Wen-Yen Shen, Hsinchu (TW); Kuang-Ling Wei, Hsinchu (TW); Chuan-Lang Lu, Hsinchu (TW)

(73) Assignee: TERA XTAL TECHNOLOGY CORPORATION, Hsinchu (TW)

( * ) Notice: Subject to any disclaimer, the term of this patent is extended or adjusted under 35 U.S.C. 154(b) by 145 days.

(21) Appl. No.: 14/187,048

(22) Filed: Feb. 21, 2014

(65) Prior Publication Data

US 2014/0256236 A1 Sep. 11, 2014

(30) Foreign Application Priority Data

Mar. 8, 2013 (TW) ..... 102204264 U
Mar. 25, 2013 (TW) ..... 102110497 A
Apr. 8, 2013 (TW) ..... 102112375 A

(51) Int. Cl.

*B24B 53/017* (2012.01)
*B24D 18/00* (2006.01)
*B24B 53/053* (2006.01)
*B24B 53/02* (2012.01)

(52) U.S. Cl.

CPC ..... *B24B 53/017* (2013.01); *B24B 53/02* (2013.01); *B24B 53/053* (2013.01); *B24D 18/00* (2013.01)

(58) Field of Classification Search

CPC ..... B24B 53/00; B24B 53/017; B24B 53/02; B24B 53/04; B24B 53/053; B24B 53/12; B24D 3/04

See application file for complete search history.

(56) References Cited

U.S. PATENT DOCUMENTS 5,626,509 A * 5/1997 Hayashi ..... B24B 53/017 451/271
5,921,856 A * 7/1999 Zimmer ..... B24B 37/04 451/526
6,027,659 A * 2/2000 Billett ..... B24B 53/017 156/345.12
6,439,986 B1 8/2002 Myoung et al.
8,597,081 B2 * 12/2013 Choi ..... B24B 53/017 451/402
8,703,570 B2 4/2014 Sandhu
8,951,099 B2 * 2/2015 Wu ..... B24B 53/007 451/443
2008/0153398 A1 6/2008 Sung
2011/0156057 A1 * 6/2011 Mazellier ..... H01L 21/2007 257/77
2013/0126327 A1 * 5/2013 Wang ..... G06F 3/044 200/600
2014/0004780 A1 * 1/2014 Tashiro ..... B24B 37/26 451/527
2014/0120724 A1 * 5/2014 Sung ..... B24B 53/017 438/692
2015/0004787 A1 * 1/2015 Hung ..... B24B 53/017 438/692

FOREIGN PATENT DOCUMENTS

GB 816646 A 7/1959
KR 20110060045 A 6/2011
KR 101182187 B1 9/2012
TW I264345 10/2006

(Continued)

*Primary Examiner* — Timothy V Eley
(74) *Attorney, Agent, or Firm* — Mark M. Friedman

(57) ABSTRACT

A pad conditioning tool includes a sapphire chip having a side surface defining a polishing surface and a plurality of sapphire grains formed on the polishing surface in an integral manner. Each of the sapphire grains had a three-dimensional geometric structure. The sapphire grains are arranged on the polishing surface in a specific form so as to possess a specific pattern.

7 Claims, 6 Drawing Sheets

(56) References Cited

FOREIGN PATENT DOCUMENTS

| | | | |
|---|---|---|---|
| TW | I289093 | | 11/2007 |
| TW | 200841993 | A | 11/2008 |
| TW | 201036033 | A | 10/2010 |
| TW | I356449 | B | 1/2012 |
| TW | 201207169 | A | 2/2012 |

* cited by examiner

PAD CONDITIONING TOOL

CROSS-REFERENCES TO RELATED APPLICATIONS

This application claims the priorities of Taiwanese patent application No. 102108175, filed on Mar. 8, 2013, Taiwanese patent application No. 102110497, filed on Mar. 25, 2013 and Taiwanese patent application No. 102112375, filed on Apr. 8, 2013, which are incorporated herewith by reference.

BACKGROUND OF THE INVENTION

1. Field of the Invention

The present invention relates generally to a pad conditioning tool, and more particularly a pad conditioning tool that is made from sapphire material and the sapphire material has a specific orientation and the method of manufacturing the pad conditioning tool.

2. The Prior Arts

Typically, CMP (Chemical Mechanical Polishing) technique is generally applied in the production of a semiconductor, which in fact is a process of smoothing surfaces of silicone wafers or other base material with the combination of chemical and mechanical forces, so that it is named CMP. Before this technique comes into existence, other techniques like etchback, glass reflow, spin coating film are implemented for smoothing the surfaces thereof, but do not bring high effect. The IBM has developed CMP technique in late 1980, which results in extremely and fine planarization of surfaces in the semiconductors, and hence the integrated circuits in a great quantity.

The CMP technique generally includes two parts, namely: (I) Polishing (II) Conditioning. For the first part, a polishing pad is mounted on a platen while a wafer to be polished in mounted a wafer carrier via vacuum means and polishing slurry is introduced between the polishing pad and the wafer in order to smooth the surfaces when the two articles oscillate relative to one another, where the slurry smoothes and etches the surfaces by removing the protruded grains from the surfaces, thereby achieving the extremely flat surfaces. For conditioning, several thousands of sapphire grains are implanted in a pad conditioning tool, when the pad conditioning tool rotates on its axis or when two articles oscillates relative to each other so as to remove abrasive waste from the polishing pad and to ensure formation of fine trenches in the surface of the polishing pad. The conditioning process includes (i) in-situ part and (II) ex-situ part. In the in-situ part, polishing and conditioning of the pad surface is done simultaneously and maintains a certain polishing effect without the need of stopping the operation. Presently, CMP technique is applied while the pad conditioning tool removes the protruded grains and the scratches so that the external surface of the polishing pad is formed with new abrasive clearances to absorb the newly introduced slurry, thereby establishing new celia and removal-enhancing material. In the ex-situ part, the conditioning process on the polishing pad is conducted only after finishing the polishing process of the surfaces.

In order for the polishing pad to possess stability of CMP performance, a diamond conditioning tool is implemented so as to maintain the outer surface of the polishing with trenches so as to facilitate removal of by products (waste) therefrom. Referring to FIGS. 1A-2A, which illustrate a prior art pad conditioning tool, includes a plurality of diamond grains B formed on a metal substrate A via sintering or adhesive method. Because the diamond grains B protrude outwardly from the outer surface at different heights, the exterior appearance and dimension is not uniform so that the diamond conditioning tool can only provide roughly about 10% polishing effect. Note that thousands of diamond grains B are electroplated or via brazing sintering process onto the metal substrate A so that there exist co-relation between the surface areas and the number of diamond grains B mounted within the surface area and the diamond grains B at the adjoining surfaces may fall off owing to contraction and expansion of the metal substrate at different temperatures. Another way for mounting the diamond polishing grains B is that an adhesion layer C is firstly coated on the metal substrate A, and the diamond grains B are implanted on the adhesion layer C. The diamond grains B may fall off the adhesion layer C upon introduction of the slurry and the etching process on the adhesion layer C, which, in turn, may result in scratches partially or wholly on the wafer being polished.

Taiwan Patent No. 1264345 discloses a CMP (Chemical Mechanical Polishing) pad conditioning tool, which has strong binding effects for the polishing grains. The pad conditioning tool includes a resin layer, a plurality of super polishing grains implanted securely on the resin layer, the super polishing grains are exposed from the resin layer and an electroplated metal layer between the resin layer and the super polishing grains, wherein a certain of the super polishing grains are exposed to an exterior of the electroplated metal layer. Comparing with those without the electroplated metal layer, the electroplated metal layer provides enhanced adhesion of the super polishing grains relative to the resin layer. However, this patent cannot eliminate the problem of the polishing slurry etching the resin layer, thereby leading to easily falling off the super polishing grains from the pad conditioning tool.

Taiwan Patent No. 1289093 discloses a method of manufacturing a diamond disc. The method accordingly includes the steps of: preparing a container; forming an adhesion layer within the container; covering the adhesion layer with a hollow member having a plurality of meshes; providing a plurality of diamond grains in the meshes of the hollow member in such a manner that the diamond grains are bond on the adhesion layer; afterward, a resin material is introduced into the container such that the diamond grains are implanted securely on the resin material. Finally, the resin material together with the diamond grains is removed from the container so as to achieve the diamond disc, in which the diamond grains are distributed uniformly and in which the diamond grains has the same orientation. This method though cures some problems, but when the resin material comes into contact with the polishing slurry, the reaction causes an etching process that may cause the diamond grains to fall off, which, in turn, may result in scratches partially or wholly on the article (like wafer) which has been polished.

Of late, another pad conditioning tool has been developed, which includes an integrally formed polishing pad made from ceramic material and which can avoid the problem of falling off the diamond grains. However, the total rigidity or hardness of the polishing pad is relatively smaller than that of the diamond grains and still suffers being etched phenomenon when coming into contact with the polishing slurry.

Therefore, how to develop a pad conditioning tool, which does not suffers the disadvantages, like the diamond grains falling off the metal substrate owing to expansion and contraction of the metal substrate at different temperatures, etching of the adhesion layer in coming contact with the polishing slurry, resulting of scratches on the surface of the article (like wafer) which has been polished, the pad conditioning tool serving a longer service life and providing high yield of the finished products.

SUMMARY OF THE INVENTION

A primary object of the present invention is to provide a pad conditioning tool which includes a sapphire chip having a side surface defining a polishing surface and a plurality of sapphire grains formed on the polishing surface in an integral manner. No electroplating or sintering process is required for implanting the sapphire grains on the polishing surface and hence avoids the problem of falling off sapphire grains in addition to remaining of scratches on the ground surface of the articles being polished. In one way, CMP performance or the product yield of the tool is increased owing to uniform dimension of the sapphire grains and number of working crystals, hence lowing the polishing speed of the article being polished, prolonging the service life of the sapphire grains, and hence the service life of the pad conditioning tool.

The other object of the present invention is to provide a method for manufacturing a pad conditioning tool, in which, an outer surface of a sapphire chip is treated by micro etching process so as to implant a plurality of sapphire grains thereon. The plurality of sapphire grains have the uniform dimension so as to avoid forming of scratches on the polishing surface of the wafer being polished, which, in turn, results in high yield of the articles.

In order to achieve the object of the present invention, the pad conditioning tool includes a sapphire chip having a side surface defining a polishing surface; and a plurality of sapphire grains formed on the polishing surface in an integral manner. Each of the sapphire grains has a three-dimensional geometric structure and the sapphire grains are arranged in a specific form so as to possess a specific pattern.

In n order to achieve the object of the present invention, the method for manufacturing a pad conditioning tool, includes the steps of: preparing a sapphire chip; conducting micro etching process on the sapphire chip so as to form a plurality of sapphire grains on an outer surface of the sapphire chip, wherein each of the sapphire grains is integrally formed with the sapphire chip and has a three-dimensional geometric structure and being arranged in a specific form so as to possess a specific pattern.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

In the prior art, the plurality of diamond grains are formed securely on the metal substrate via the embedding, electroplating, sintering process or adhesion method such that the diamond grains at the adjoining surface areas are subjected to fall off owing to expansion and contraction of metal substrate at different temperatures. In addition, the diamond grains fall off the metal substrate owing to reaction when the polishing slurry is introduced, which etches the adhesion layer to loose sticking ability, which, in turn, results in reduced yield of the wafer products. Scratches are often formed on the finished semiconductor products.

Figure 1A:
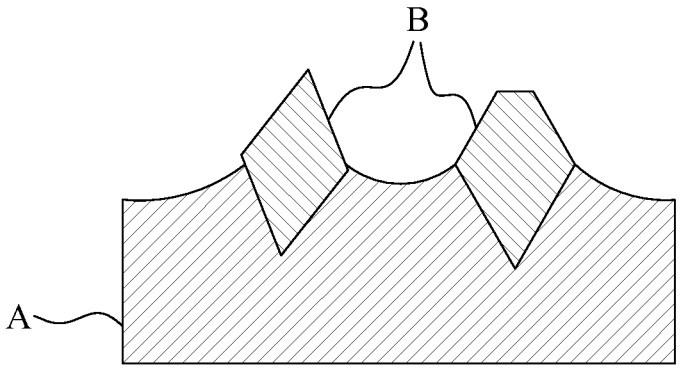
FIG. 1A (PRIOR ART)
FIGS. 1A and 1B respectively illustrate a prior art pad conditioning tool.
Figure 1B:
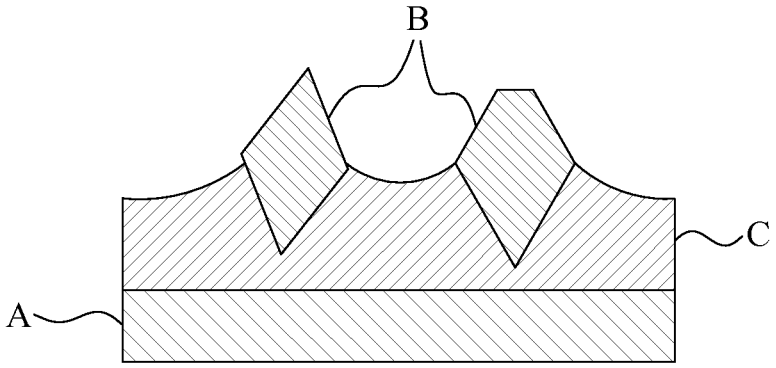
FIG. 1B (PRIOR ART)
Figure 2A:
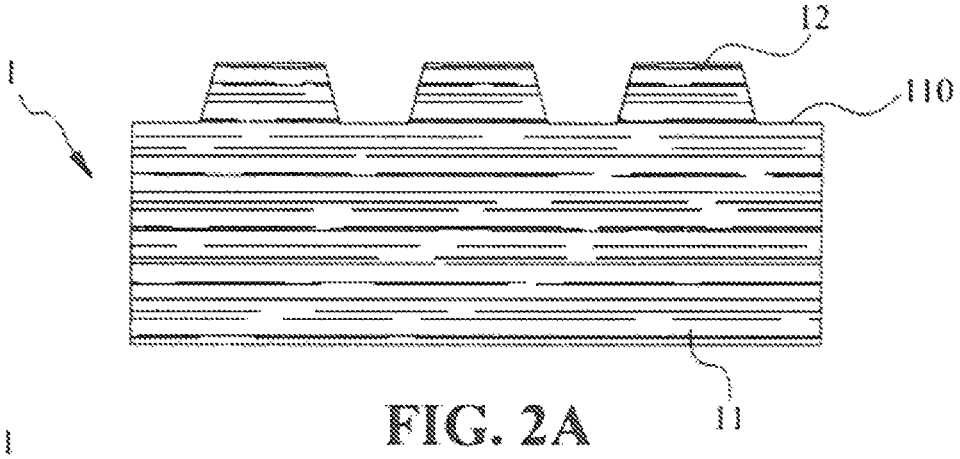
FIGS. 2A, 2B and 2C respectively illustrate configuration of sapphire grains implemented a pad conditioning tool of the present invention.

FIG. 2A shows one embodiment of the pad conditioning tool 1 of the present invention. As illustrated, the pad conditioning tool 1 of the present invention includes a sapphire chip 11 having a side surface defining a polishing surface 110, and a plurality of sapphire grains 12 formed on the polishing surface 110 in an integral manner. Each of the sapphire grains 12 has a three-dimensional geometric structure. In this embodiment, the sapphire grains 12 are arranged on the polishing surface 110 in a specific form so as to possess a specific pattern.

Preferably, each of the sapphire grains 12 has a height ranging 50~200 μm.

In this embodiment, the sapphire chip 11 has a specific orientation plane consisting of at least A plane, C plane, R plane, M plane, N plane and V plane, wherein the A plane includes $[11\bar{2}0]$, $[1\bar{2}10]$, $[2\bar{1}\bar{1}0]$, $[\bar{1}\bar{1}20]$, $[\bar{2}110]$ and $[\bar{1}2\bar{1}0]$, the C plane includes [0001], the R plane includes $[10\bar{1}1]$, $[\bar{1}01\bar{1}]$, $[01\bar{1}\bar{1}]$, $[0\bar{1}11]$, $[1\bar{1}0\bar{1}]$ and $[\bar{1}101]$, the M plane includes $[\bar{1}010]$, $[\bar{1}100]$, $[01\bar{1}0]$, $[10\bar{1}0]$, $[1\bar{1}00]$ and $[0\bar{1}10]$, the N plane includes $[22\bar{4}3]$, and the V plane includes $[44\bar{8}3]$.

Preferably, each of the sapphire grains 12 has a height error of 5% with respect to an average height.

In this embodiment, the pad conditioning tool 1 of the present invention further includes a protection sheath 13 formed on the sapphire grains 12. Preferably, the protection sheath 13 is selected from a group consisting of a sapphire layer and a DLC (diamond like carbon) layer covering the polishing surface 110 of the sapphire chip 11.

Figure 2B:
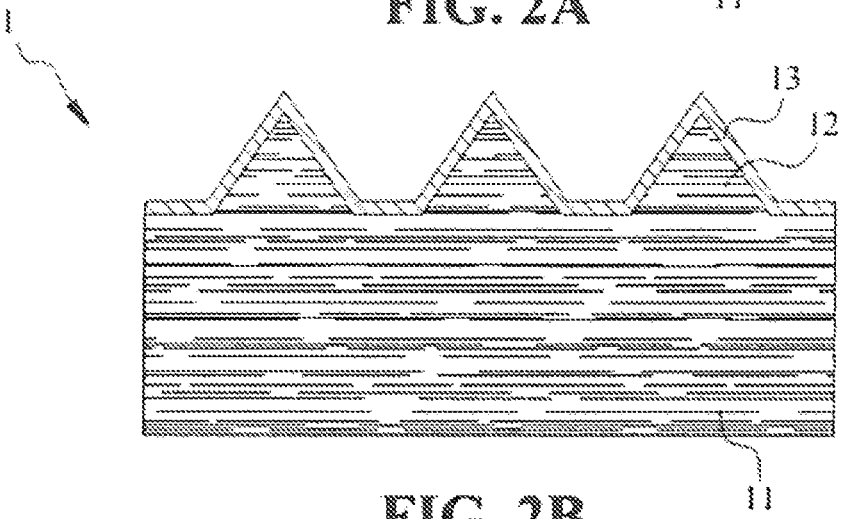
Figure 2C:
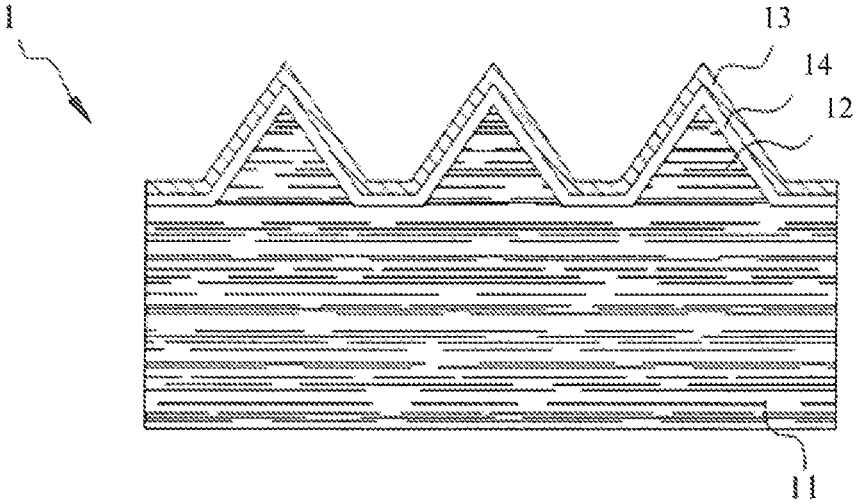

Referring to FIG. 2C, the pad conditioning tool 1 of the present invention further includes a buffer layer 14 disposed between the polishing surface 110 and the protection sheath 13. Preferably, the buffer layer 14 is made from materials consisting of titanium, platinum, brass, aluminum oxides with doped titanium, titanium oxides, a mixture of aluminum oxides and titanium oxides and graphene.

Referring again to FIGS. 2A and 2B, each of the sapphire grains 12 has a structure or configuration consisting of a pointed cone column, a flat cone column, a three-sided cone column, a flat three-sided cone column or a combination thereof. FIGS. 2A and 2B show the pointed cone column and the flat cone column, and the configuration of the sapphire grains 12 can be altered according to the requirement of the functional purpose. More preferably, each of the sapphire chip 11 and the sapphire grains 12 is either a mono crystal structure, a poly crystal structure or a combination of both.

Figure 3A:
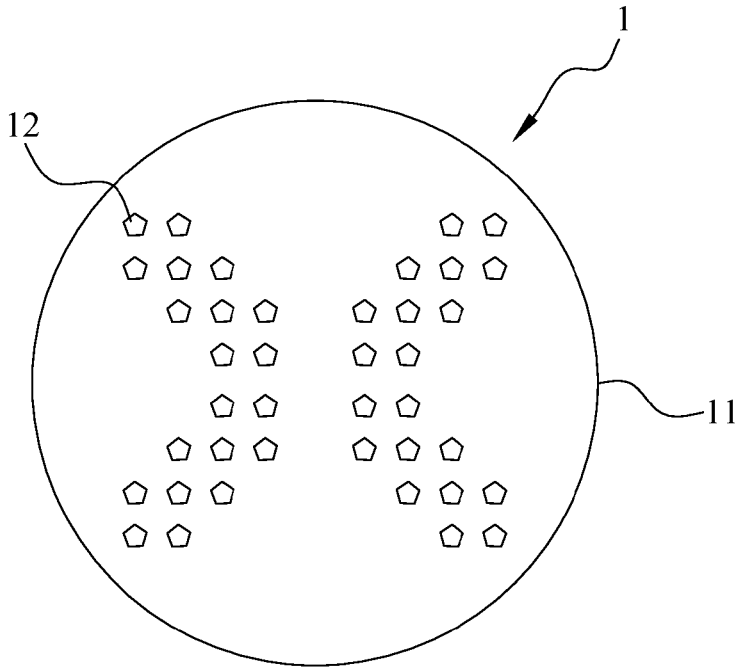
FIGS. 3A and 3B respectively show top planar view illustrating specific patterns formed by the sapphire grains implemented the pad conditioning tool of the present invention.
Figure 3B:
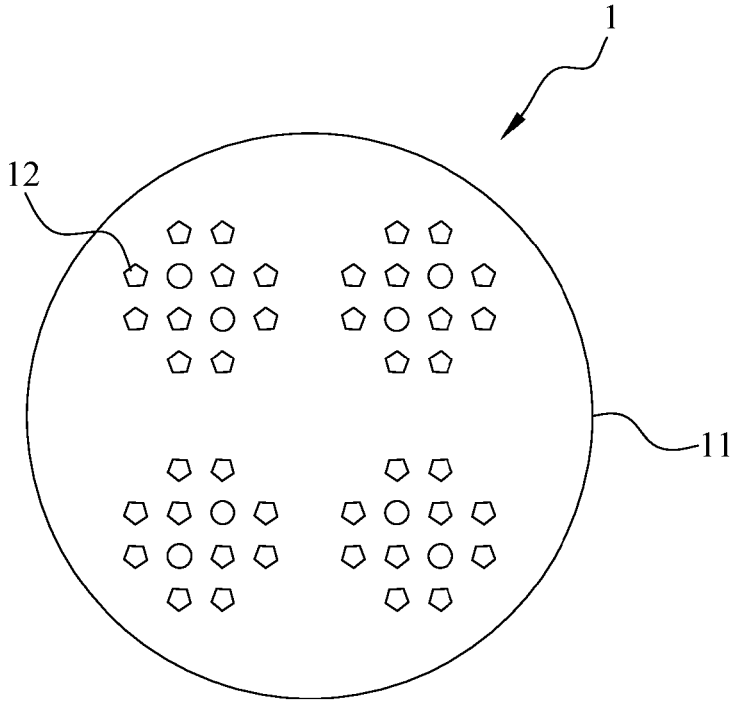

FIGS. 3A and 3B respectively show top planar view illustrating specific patterns formed by the sapphire grains implemented the pad conditioning tool of the present invention. As shown in FIG. 3A, the sapphire grains 12 are arranged on the polishing surface 110 in a specific form so as to possess a specific pattern. Alternately, the sapphire grains 12 can be arranged randomly, but the arrangement should not be limited only to these. FIG. 3B shows another specific arrangement, wherein the pattern shown in FIG. 3B is different from that of FIG. 3A.

It is to note that since the sapphire grains 12 are integrally formed with the polishing surface 110 of the sapphire chip 11, they are not liable to fall off the polishing surface 110 during the polishing operation, which, in turn, provides high yield in the manufacturing process of the semiconductor product and longer service life.

Figure 4:
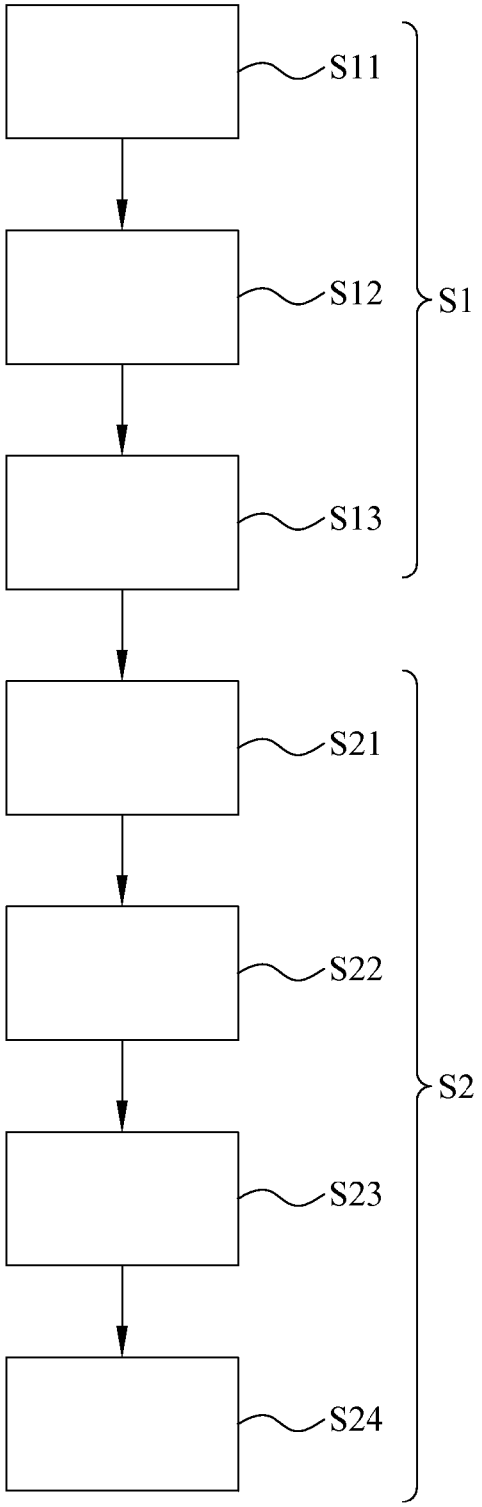
FIG. 4 shows a block diagram of one embodiment of a method for manufacturing the pad conditioning tool of the present invention.

FIG. 4 shows a block diagram of a method for manufacturing a pad conditioning tool of the present invention. The method for manufacturing the pad conditioning tool of the present invention includes: step S1: preparing a sapphire chip; and step S2: conducting micro etching process on the sapphire chip so as to form a plurality of sapphire grains on an outer surface of the sapphire chip.

Preferably, the step S1 of the preparing sapphire chip further includes step S11, where raw materials are melted in high sintering oven; step S12, forming an ingot with a specific orientation plane from the wafer under the specific orientation plane; and S13, cutting the ingot in order to obtain the sapphire chip possessing the specific plane, wherein the specific orientation plane consists of at least A plane, C plane, R plane, M plane, N plane and V plane, wherein the A plane includes $[11\bar{2}0]$, $[1\bar{2}10]$, $[2\bar{1}\bar{1}0]$, $[\bar{1}\bar{1}20]$, $[\bar{2}110]$ and $[\bar{1}2\bar{1}0]$, the C plane includes [0001], the R plane includes $[10\bar{1}1]$, $[\bar{1}01\bar{1}]$, $[01\bar{1}\bar{1}]$, $[0\bar{1}11]$, $[1\bar{1}0\bar{1}]$ and $[\bar{1}101]$, the M plane includes $[\bar{1}010]$, $[\bar{1}100]$, $[01\bar{1}0]$, $[10\bar{1}0]$, $[1\bar{1}00]$ and $[0\bar{1}10]$, the N plane includes $[22\bar{4}3]$, and the V plane includes $[44\bar{8}3]$.

In this method, the step S2 of the conducting micro etching process further includes substep: S21, coating a light resistance layer on an outer surface of the sapphire chip; S22, forming a light mask on the light resistance layer in such a manner to expose the light resistance layer; S23, after immersion exposure, the resistance layer is formed with a display image; and S24, conducting micro etching process so as to form a plurality of sapphire grains on the outer surface of the sapphire chip.

Preferably, the light resistance layer is a negative or positive resistance layer with a thickness ranging 20~200 μm. Each of the sapphire grains has a height ranging 50~200 μm. Each of the sapphire grains 12 has a structure or configuration consisting of a pointed cone column, a flat cone column, a three-sided cone column, a flat three-sided cone column or a combination thereof. The light source for exposure is selected from a group consisting of UV (ultraviolet) light, FUV (far ultraviolet) light, X-ray light, electron beam and ion beam. Preferably, each of the sapphire chip and the sapphire grains is either a mono crystal structure, a poly crystal structure or a combination of both.

In this embodiment, the etching process is a dry etching, a wet etching or a combination of both. In case of combination type is selected, the dry etching is firstly conducted follow by the wet etching. The gas applied in the dry type is selected from a group consisting of $BCl_3/Cl_2/Ar$ or $BCl_3/HBr/Ar$. The solution applied in the wet etching is selected from a group consisting of $H_2SO_4/H_3PO_4$, $Br_2/MeOH$ or $NH_4OH/H_2O_2/H_2O$.

In addition, the method of the present invention further includes after the micro etching process, S100, a heat treatment step, where the sapphire chip with the plurality of the sapphire grains is inserted into a high sintering oven for undergoing sintering operation so as to remedy lattice defects.

Figure 5:
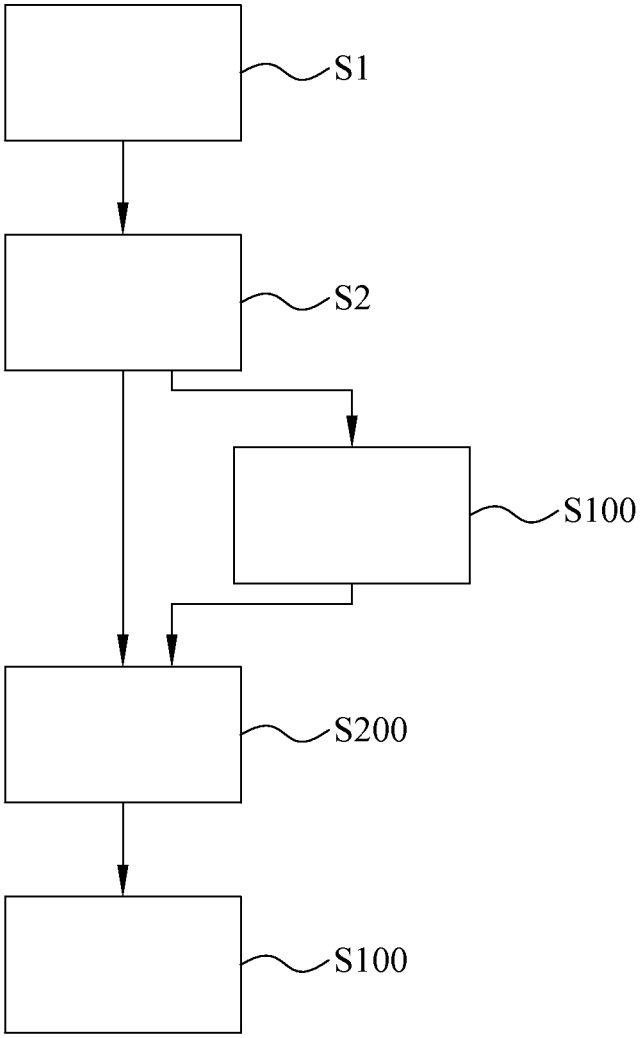
FIG. 5 shows a block diagram of another embodiment of the method for manufacturing the pad conditioning tool of the present invention.

FIG. 5 illustrates the steps in another embodiment of the method of the present invention for manufacturing the pad conditioning tool. The method includes step S1: preparing the sapphire chip; and S2: conducting micro etching process on the sapphire chip so as to form a plurality of sapphire grains on an outer surface of the sapphire chip. The method further includes after the micro etching process S2, step S200, a protection sheath formation step, where one of a sputtering, organic chemical vapor deposition, Plasma chemical vapor deposition, LPCVD (low pressure chemical vapor deposition), Pulsed laser deposition or Arc ion deposition is conducted so as to form a protection sheath 13 on an outer surface of the sapphire chip.

In this embodiment, the method of the present invention further includes after the micro etching process S2, a heat treatment step S100, where the sapphire chip with the plurality of sapphire grains is inserted into a high sintering oven for undergoing sintering operation so as to remedy lattice defects and so as to enhance adhesion of the protection sheath 13 on the outer surface of the sapphire chip. Another heat treatment step S100 is conducted after the protection sheath formation step S200.

Figure 6:
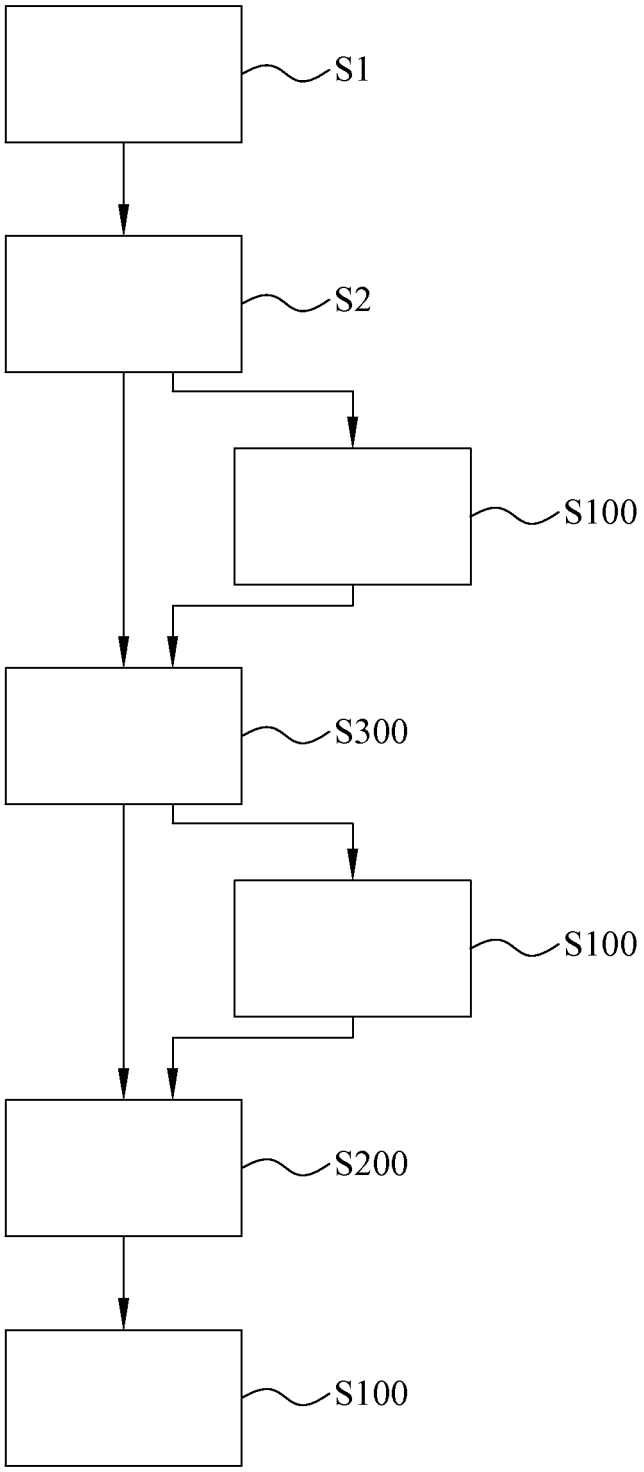
FIG. 6 shows a block diagram of yet another embodiment of the method for manufacturing the pad conditioning tool of the present invention.

FIG. 6 shows yet another embodiment of the method of the present invention for manufacturing the pad conditioning tool. The steps includes step S1: preparing the sapphire chip; and S2: conducting micro etching process on the sapphire chip so as to form a plurality of sapphire grains on an outer surface of the sapphire chip. The method further includes between the micro etching process S2 and the protection sheath formation step S200, a buffer layer formation step S300, where a buffer layer is formed on the outer surface of the sapphire chip via at least one of evaporation, sputtering, MOCVD (metal organic chemical vapor deposition), PECVD (plasma-enhanced chemical vapor deposition), LPCVD (low pressure chemical vapor deposition), PLD (programmable logic device) and AIP (arc ion plating).

In this embodiment, the method further includes after the micro etching process S2, a heat treatment step S100, where the sapphire chip with the plurality of sapphire grains is inserted into a high sintering oven for undergoing sintering operation so as to remedy lattice defects and so as to enhance adhesion of the protection sheath on the outer surface of the sapphire chip. Note that the temperature of the sintering oven should be maintained between 1000° C.~1800° C. for at least 1-8 hours.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A pad conditioning tool comprising:

a sapphire chip having a side surface defining a polishing surface;

a plurality of sapphire grains formed on said polishing surface in an integral manner, each of said sapphire grains having a three-dimensional geometric structure and said sapphire grains being arranged in a specific form so as to possess a specific pattern, a protection sheath forming on the sapphire grains; and a buffer layer disposed between said polishing surface and said protection sheath, wherein the buffer layer and the protection sheath are formed on each of the sapphire grains.

2. The pad conditioning tool according to claim 1, wherein each of said sapphire grains has a height ranging from 50~200 μm.

3. The pad conditioning tool according to claim 1, wherein each of said sapphire grains has a structure selected from the group consisting of a pointed cone column, a flat cone column, a three-sided cone column and a flat three-sided cone column.

4. The pad conditioning tool according to claim 1, wherein said sapphire chip and said sapphire grains is either a mono crystal structure or a poly crystal structure.

5. The pad conditioning tool according to claim 1, wherein said sapphire chip has a specific orientation plane consisting of at least A plane, C plane, R plane, M plane, N plane and V plane, said A plane including $[11\bar{2}0]$, $[1\bar{2}10]$, $[2\bar{1}\bar{1}0]$, $[\bar{1}\bar{1}20]$, $[\bar{2}110]$, and $[\bar{1}2\bar{1}0]$, said C plane including $[0001]$, said R plane including $[10\bar{1}1]$, $[\bar{1}01\bar{1}]$, $[01\bar{1}\bar{1}]$, $[0\bar{1}11]$, $[1\bar{1}0\bar{1}]$ and $[\bar{1}101]$, said M plane including $[\bar{1}010]$, $[\bar{1}100]$, $[01\bar{1}0]$, $[10\bar{1}0]$, $[1\bar{1}00]$ and $[0\bar{1}10]$, said N plane including $[22\bar{4}3]$, and said V plane including $[44\bar{8}3]$.

6. The pad conditioning tool according to claim 1, wherein said protection sheath is selected from a group consisting of a sapphire layer and a DLC (diamond like carbon) layer covering said polishing surface of said sapphire chip.

7. The pad conditioning tool according to claim 1, wherein said buffer layer is made from a material selected from the group consisting of titanium, platinum, brass, aluminum oxides with doped titanium, titanium oxides, a mixture of aluminum oxides with titanium oxides and graphene.

* * * * *